United States Patent [19]

Peterson

[11] 3,947,081

[45] Mar. 30, 1976

[54] LOW INSERTION FORCE CIRCULAR ELECTRICAL CONNECTOR

[75] Inventor: Carl W. Peterson, Santa Ana, Calif.

[73] Assignee: International Telephone & Telegraph Corporation, New York, N.Y.

[22] Filed: Nov. 11, 1974

[21] Appl. No.: 522,442

[52] U.S. Cl. ..... 339/75 M; 339/90 R; 339/DIG. 2

[51] Int. Cl.[2] ..... H01R 13/54

[58] Field of Search ..... 339/75 R, 75 M, 75 MP, 339/90 R, 90 C, 90 F, DIG. 2

[56] References Cited

UNITED STATES PATENTS

| | | | |
|---|---|---|---|
| 2,684,860 | 7/1954 | Rafferty | 339/90 R |
| 3,455,580 | 7/1969 | Howard | 339/90 R |
| 3,601,764 | 8/1971 | Cameron | 339/DIG. 2 |
| 3,818,420 | 6/1974 | Barr | 339/90 R |

*Primary Examiner*—Roy Lake
*Assistant Examiner*—Mark S. Bicks
*Attorney, Agent, or Firm*—Thomas L. Peterson

[57] ABSTRACT

A low insertion force electrical connector having a pair of connector members each with a plurality of contacts therein. One of the connector members includes a stationary insulator and an activating disc, receiving contacts mounted in axially aligned bores in the two parts. A shell surrounding the activating disc has an arcuate cam surface thereon which cooperates with a roller bearing on the activating disc to cause the activating disc to shift with respect to the axes of the contact bores upon rotation of the shell to cause the contacts of the two connector members to engage. An interlock is formed on the shell for allowing the connector members to be correctly positioned prior to electrically connecting the contacts together. The interlock includes spring detent means for connector retention and for providing an audio and tactile indication of full mating of the connector members.

5 Claims, 14 Drawing Figures

LOW INSERTION FORCE CIRCULAR ELECTRICAL CONNECTOR

BACKGROUND OF THE INVENTION

The present invention relates generally to an electrical connector and, more particularly, to a low insertion force circular electrical connector.

The present invention comprises an improvement upon the low insertion force circular connector disclosed in U.S. Pat. No. 3,818,420 to John E. Barr, assigned to the assignee of the present application. The Barr patent discloses a circular connector having a pair of connectors each with a plurality of contacts therein. One of the connector members includes a stationary insulator and an activating disc, formed with a plurality of axially aligned bores therein receiving contacts. A rotatable shell surrounds the activating disc. The shell is formed with a cam tooth on the inner surface thereof. When the shell is rotated, the cam tooth cooperates with an arcuate cam surface on the activating disc to shift the disc with respect to the axes of the bores to interengage the electrical contacts in the respective connector members. The cam tooth loads the contacts in the last few degrees of rotation of the shell because the cam surface on the activating disc has a relatively hard rise angle. These characteristics cause excessive resistance and wear of the mating cam surfaces on the activating disc and shell, causing loss of mechanical integrity of the mated contacts after just a few actuations of the contacts in the connector. The loss of mechanical integrity of the contacts results in loss of electrical continuity in the connector. Also, this construction requires that the shell be formed of a relatively resilient material, thereby limiting the types of materials that can be utilized for manufacture of the shell. Further, this arrangement requires a high torque for mating of the two connector members.

The Barr patent also discloses an interlock arrangement for the two connector members of the connector. The shell on the plug connector member is formed with a pair of oppositely disposed teeth on the inner surface therein which engage in L-shaped grooves formed on the receptacle connector member. In a commercial embodiment of the Barr connector, raised areas are formed on the circumferentially extending portions of the L-shaped grooves, causing the shell to elongate when the shell is rotated to interconnect the contacts of the two connector members. When the shell reaches its fully mated position, it contracts or snaps back for retention and a tactile and audio indication of the fully mated condition of the connector. These characteristics may cause excessive torque and wear and again limits the type of material that can be utilized for the shell.

The purpose of the present invention is to overcome the attendant disadvantage of the aforementioned prior art zero force circular connector, by providing an arrangement which requires lower torque for mating the connector members together without loss of retention or tactile indication of the mating of the members. Another object of the invention is to improve the mechanical integrity of the connector in the areas of cam action, wear and resistance, so as to increase the useful life of the connector.

SUMMARY OF THE INVENTION

According to the principal aspect of the present invention, a low insertion force circular electrical connector of the type disclosed in the Barr patent is improved by providing a gradual arcuate cam surface on the inner surface of the coupling ring or shell member of the plug connector member providing a lower force angle and by mounting a pin bearing in the outer surface of the activating disc which is engaged by the cam surface on the shell member. In addition, a notch is provided in the surface of the shell member which receives the pin bearing when the activating disc is shifted to the position actuating the contacts in their respective connector members. By this arrangement, a more gradual approach of full contact load is made minimizing the amount of torque required for making engagement between the contacts in the two connector members. In addition, this arrangement allows for the full contact load to be distributed over greater rotation of the shell and minimizes wear and resistance of the mating cam surfaces. Also, at the fully mated position of the connector the load on the pin bearing is relieved by engaging the notch on the shell member thereby minimizing stresses on the shell member and in addition providing both an audio and tactile indication of when the fully mated position of the shell member is reached.

According to another aspect of the invention, the interlock between the shell member on the plug connector member and the mating receptacle connector member in the Barr device may be modified to relieve the torque and the wear which otherwise exists. The raised areas formed in the circumferentially extending portion of the L-shaped slot of the interlock arrangement are replaced by spring detent means which do not require the shell member to elongate during the mating operation of the connector members yet still provides retention for the connector members and a tactile and audio indication that the fully mated condition has been achieved. In addition, the use of a spring detent means in the groove lessens the torque required for mating the two connector members and minimizes wear.

DESCRIPTION OF THE PREFERRED EMBODIMENT

Figure 1:
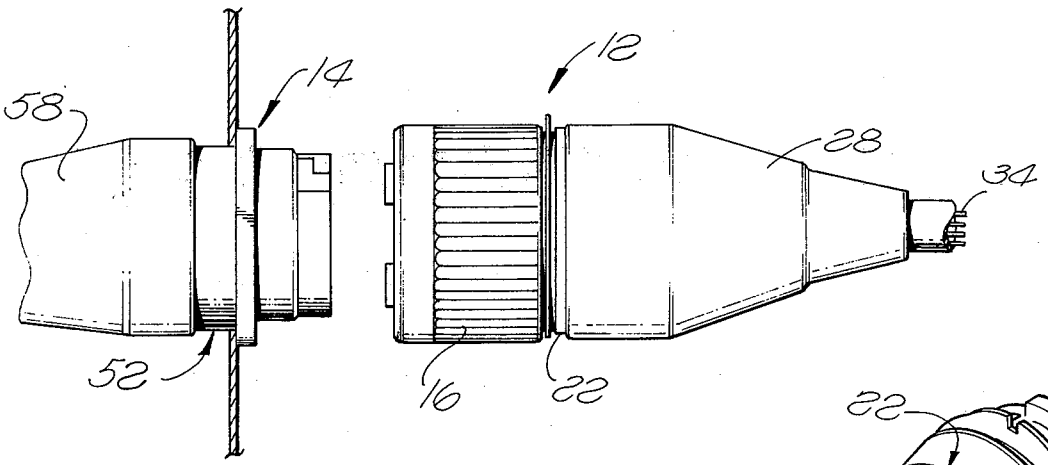
FIG. 1 is an elevational view of the plug and receptacle connector members constructed in accordance with the present invention.

Referring now to the drawings in detail, there is shown a mated pair of connector members comprising a plug connector 12 and a receptacle connector 14. The plug connector, which is shown in exploded detail in FIG. 2, has a coupling ring or shell 16 at the front end thereof. Positioned within the coupling ring is a movable contact activating disc 18 made of a thermoplastic material. Behind the activating disc is a stationary insulator 22 also made of a thermoplastic material and having within the rear end thereof a wire seal grommet 24. An environmental boot 28 is provided at the rear of the connector. Further positioned within the insulator member 22 is a plurality of contacts 32 having secured at the rear end thereof a wire conductor 34.

Figure 3:
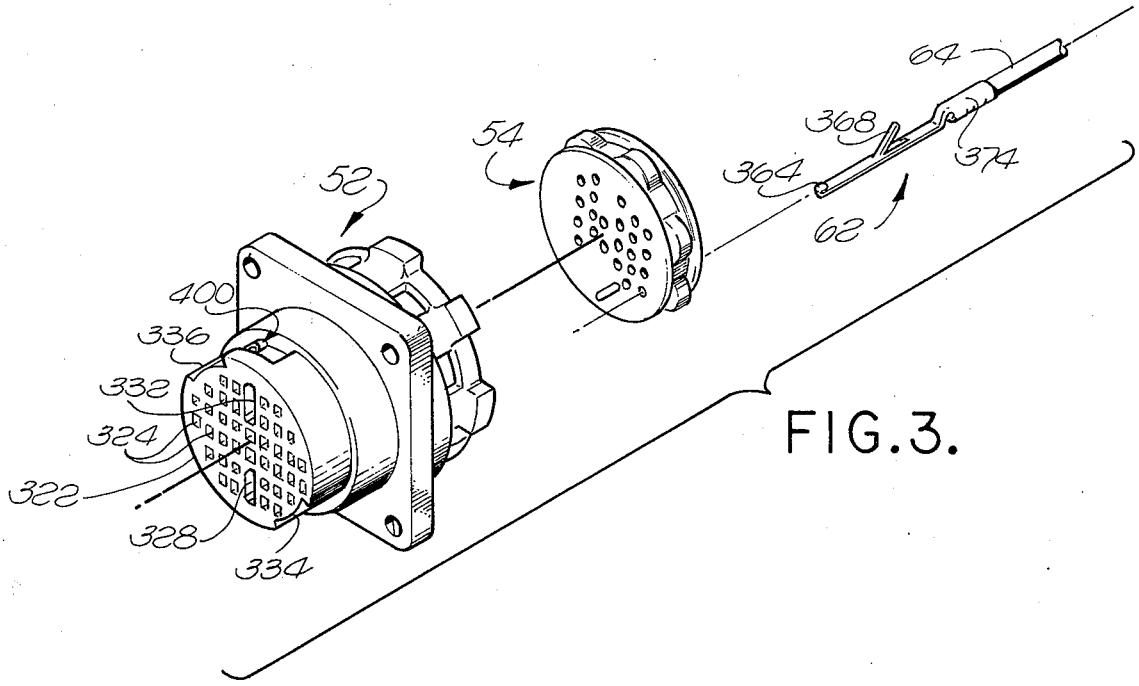
FIG. 3 is an exploded perspective view of the receptacle connector member illustrated in FIG. 1, with the environmental boot removed.

The receptacle connector member shown in exploded detail in FIG. 3 comprises an insulator member 52 having a grommet 54 which may be identical to the grommet 24 mounted within the rear end of the insulator member 52. A boot 58, as seen in FIG. 1, is mounted on the rear end of the insulator 52. A plurality of contacts 62 having wire conductors 64 secured to the ends thereof are mounted within the insulator member 52 and may be made identical to the contacts 32 in the plug connector member.

Figure 2:
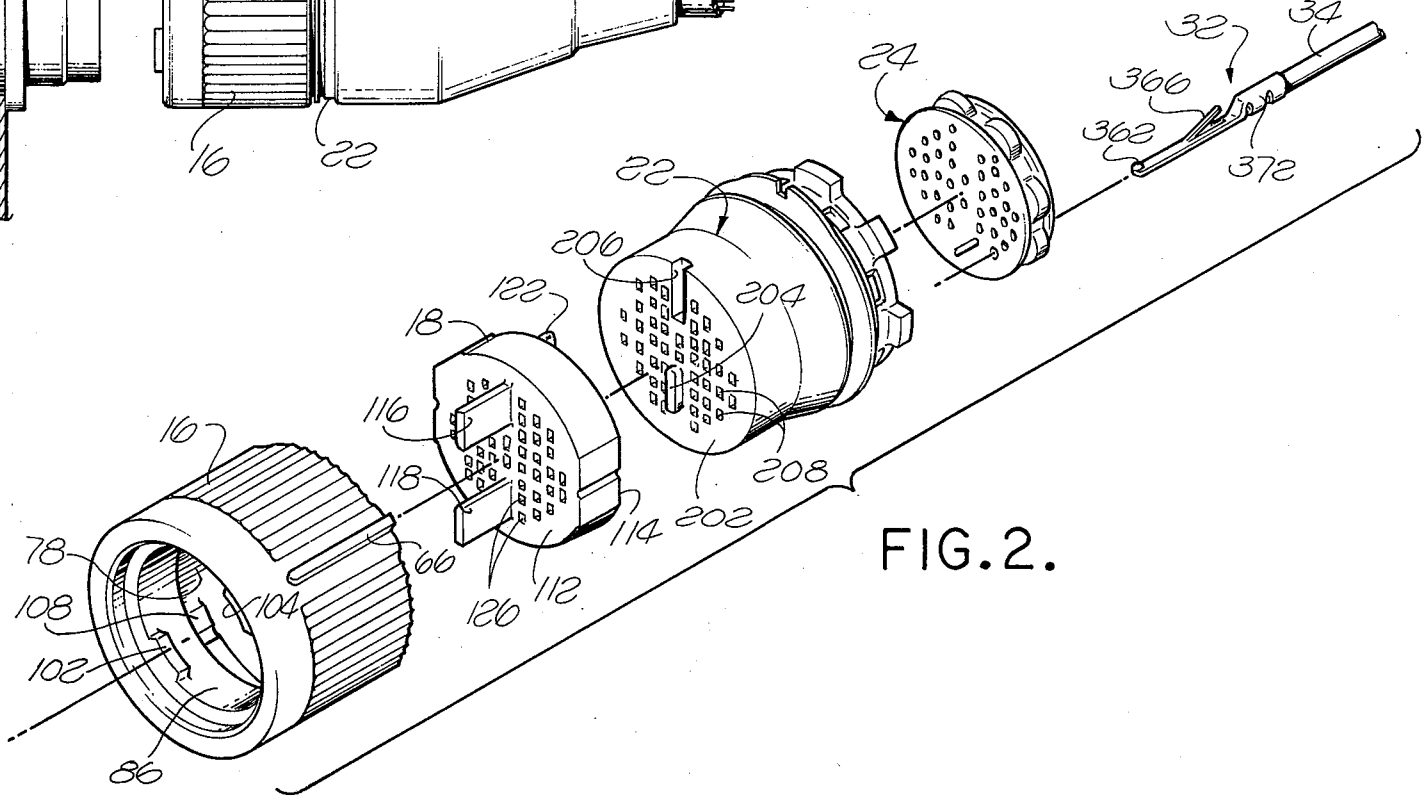
FIG. 2 is an exploded perspective view of the plug connector member illustrated in FIG. 1, with the environmental boot removed.
Figure 4:
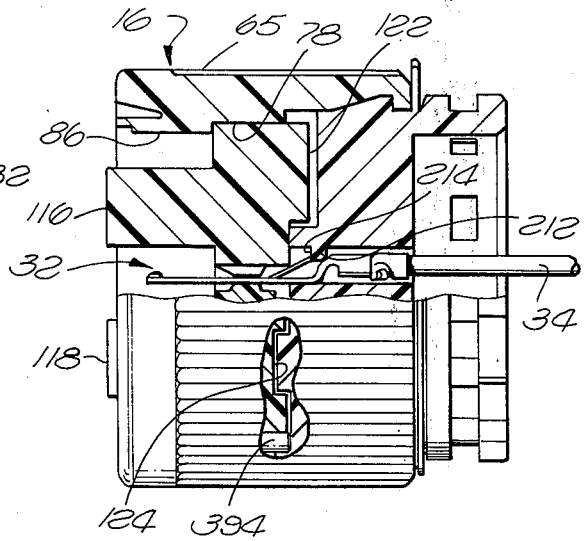
FIG. 4 is a partial longitudinal sectional view of the plug connector member illustrated in FIG. 2.

In FIG. 4, there is shown a partial cross-sectional view of the plug connector, with the grommet 24 removed. The coupling ring 16 is typically knurled at the rear outer surface 65 and may contain a raised portion 66 along the surface 65 for use as a position indicator during mating. The coupling ring has two internal bore surfaces 78 and 86. As can be seen in FIG. 2, the bore surface 86 carries a first coupling tooth 102 and a second coupling tooth 104. The teeth 102 and 104 are approximately 180° apart. The teeth are typically trapezoidal with the larger base being formed internal with the bore surface 86. Further, a pair of driver teeth or cams 106 and 108 are formed on the bore surface 78 with approximately 120° spacing. The tooth 108 will be described in detail later.

The activating disc 18 has a front surface 112 and a rear surface 114. Extending forwardly from the front surface 112 are a pair of polarizing keys 116 and 118 and extending rearwardly from the surface 114 is an anti-rotation tongue 122. Further, a groove 124 is cut into the rear surface of the disc 18 and operates in combination with the tongue 122 to mate with a similar tongue and groove arrangement in the stationary insulator 22 as will be explained hereinafter. A plurality of bores 126 are formed in the insulator 18. The forward ends of the contacts 32 extend through the bores 126 beyond the front surface 112 of disc 18.

The stationary insulator 22 has a front surface 202 having a tongue 204 and groove 206 arrangement which allows the stationary insulator to be locked to the activating disc so as to prevent rotation of the disc with respect to the stationary insulator. The front half of the insulator 22 contains a plurality of bores 208 which are axially aligned with the bores 126. Each bore 208 contains a flange member 212 having a forwardly facing shoulder 214 for locking a contact 32 therein.

Figure 5:
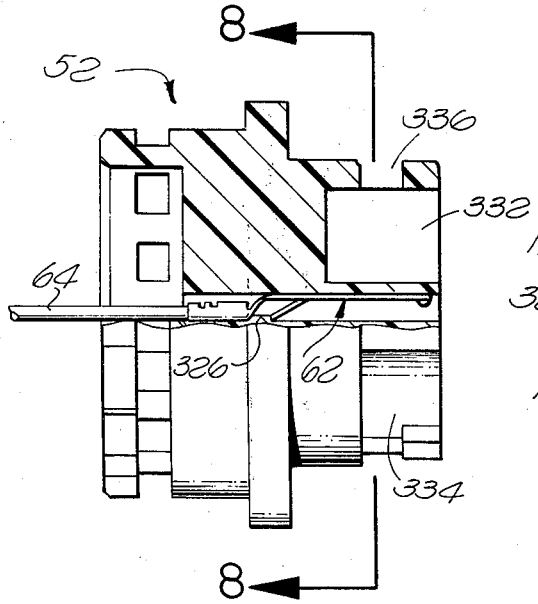
FIG. 5 is a partial longitudinal sectional view of the receptacle connector member illustrated in FIG. 3.

Referring now to FIG. 3, the insulator member 52 of the receptacle connector 14 is formed with a front reduced diameter section 322, and contains a plurality of cavities 324 therethrough into which the contacts 62 are positioned as shown in FIG. 5. Each of the bores 324 contains an inwardly extending flange 326 for locking the contacts 62 in the bore. The front end of the insulator section 322 contains a pair of keyways 328, 332 for insertion of the polarizing keys 116, 118 of the activating disc 18 of the plug connector. On the outer surface of the member 322 there are formed a pair of L-shaped coupling grooves 334, 336 which mate with the coupling teeth 102, 104 of the coupling ring 16.

As previously pointed out, the contacts 32 and 62 of the plug and receptacle connectors can be identical and each contain a contacting surface 362, 364 at the front end of the contacts, respectively. Further, locking tines 366, 368 allow the contacts to be inserted from the rear of the insulator members and abut the forward facing shoulders of the flanges 212, 326, respectively. Each of the contacts terminate in a crimp barrel 372, 374, respectively.

Figure 10:
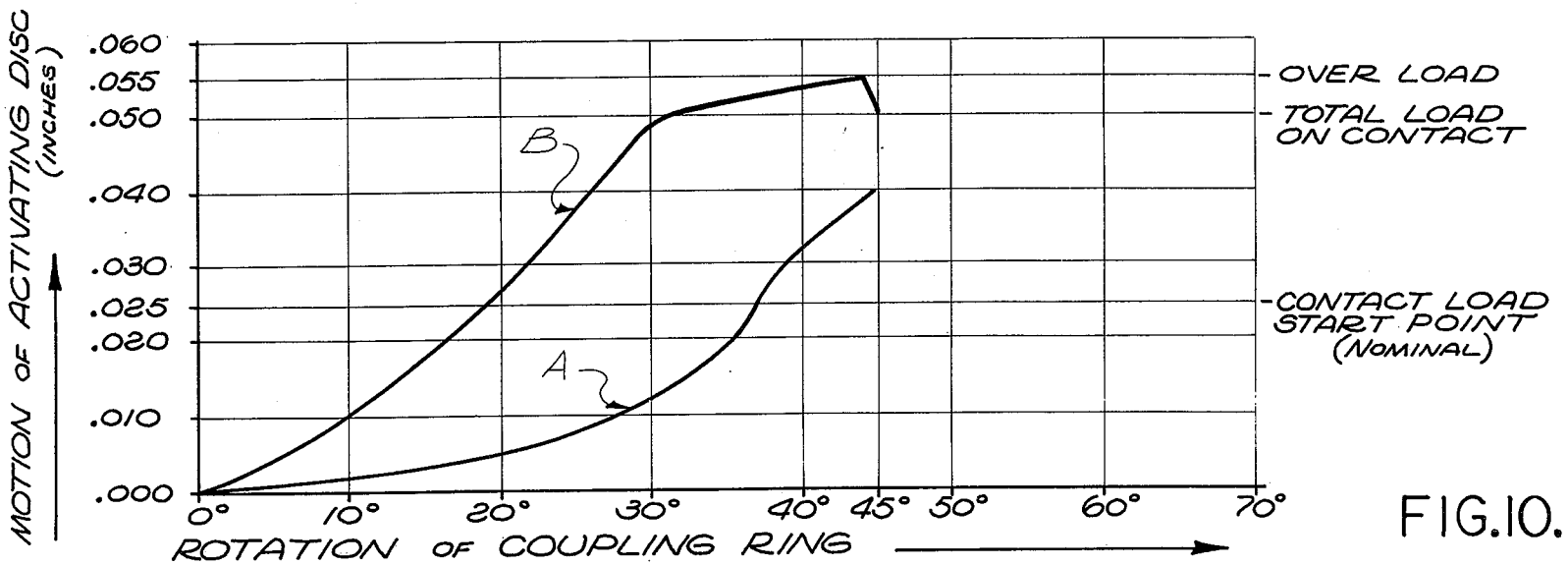
FIG. 10 is a graph comparing the cam action of the Barr connector with that of a connector constructed in accordance with the present invention.

The connector described so far is essentially identical to that described in the aforementioned Barr patent. For further details of the connector reference may be made to such patent. Reference is now made to the graph illustrated in FIG. 10 of the drawings, wherein the motion of the activating disc 18 is plotted against the rotation of the coupling ring 16 for a connector constructed in accordance with the teachings of the Barr patent (curve A) and a connector constructed in accordance with the present invention (curve B). It is noted that the graph also indicates on the right side thereof the nominal contact load start point and the total load on the contacts. It is seen from curve A that in the prior art connector the camming arrangement therein loads the contacts in its last few degrees of rotation of the coupling ring. This requires high torque for mating of the connector members and causes excessive resistance and wear of the critical areas of the connector members when in the fully mated position. As a result, there is rapid loss of mechanical integrity on the mating contacts, resulting in losses of electrical continuity in the connector. According to the present invention, a camming arrangement is provided for shifting the activating disc 18 which gives full contact load over the first 30° rotation of the coupling ring, by using a lower force angle and a pin bearing as will now be described.

Figure 7A:
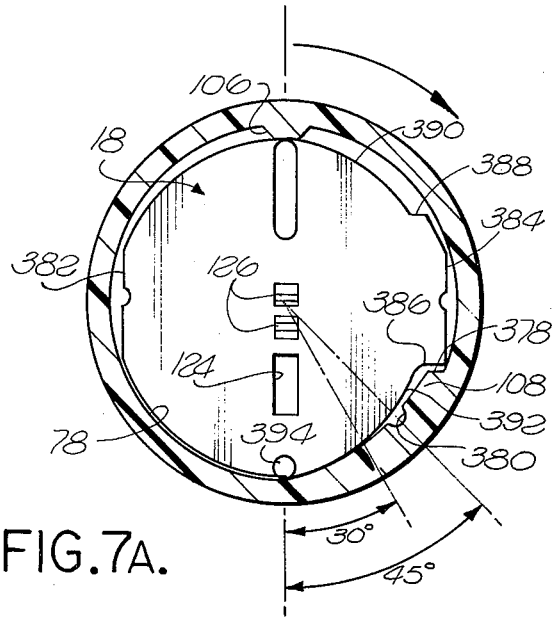
FIG. 7(*a–c*) depict the movement of the coupling ring in a position comparable to the contacts of FIG. 6(*a–c*), respectively.
Figure 6A:
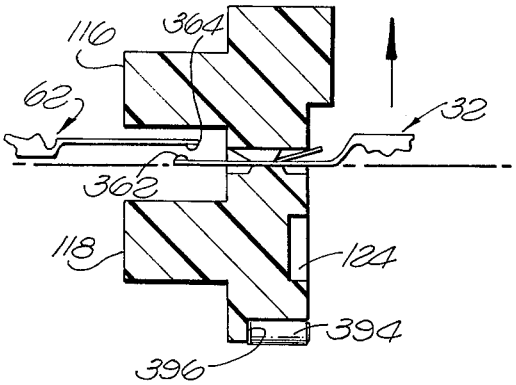
FIG. 6(*a–c*) shows various stages of movement of the contacts during the contact engagement process.
Figure 7B:
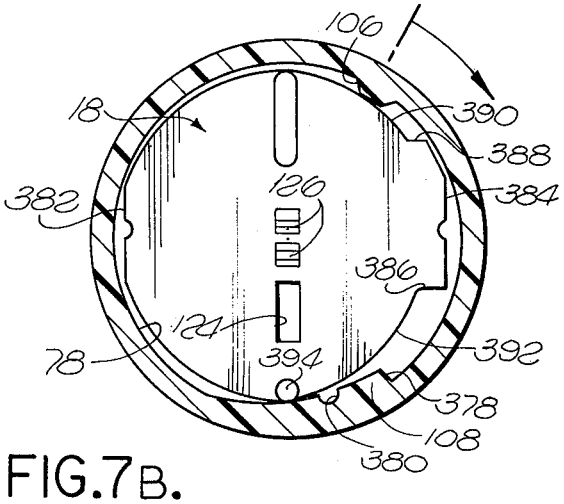
Figure 6B:
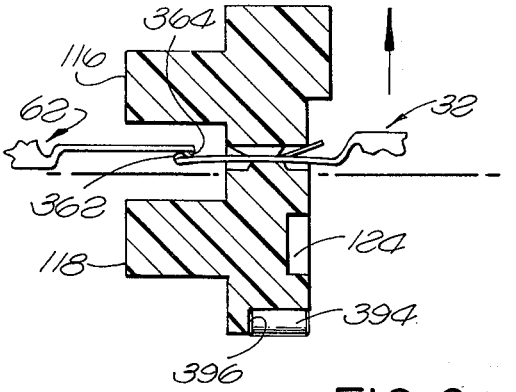
Figure 7C:
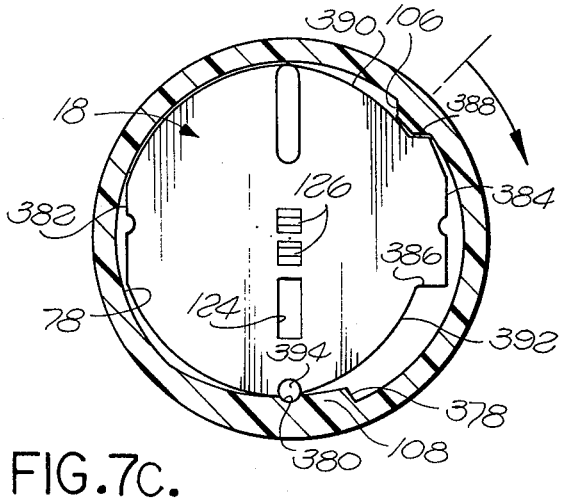
Figure 6C:
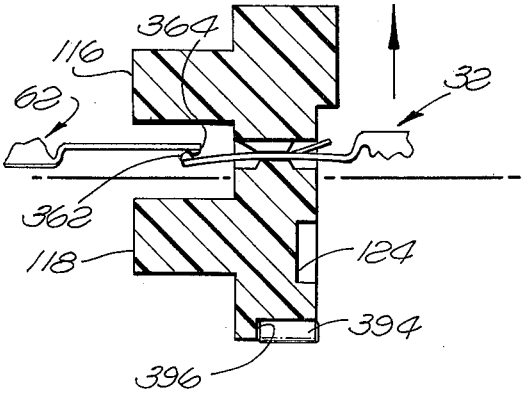

Referring to FIGS. 6 and 7 in detail, it is noted that the driver tooth 106 on the coupling ring is relatively short and has a configuration like that illustrated in the Barr patent. However, the opposite driving tooth 108 has been considerably modified in that the inner surface 376 thereof has an arcuate configuration which extends approximately 60° and gradually decreases radially to a generally radially extending shoulder 378. A curved notch 380 is formed in the surface 376 approximately 45° offset from the point where the arcuate inner surface 376 of the tooth 108 merges with the cylindrical inner surface 78 of the coupling ring 16, which as illustrated in FIG. 7(*a*) is at the point of the vertical plane passing through the axis of the connector when the coupling ring is in its inactivated position. The activating disc 18 is formed with a pair of flat portions 382 and 384 on opposite sides thereof. Generally radially extending shoulders 386 and 388 are formed on the activating disc adjacent to the ends of the flat portion 384. The disc 18 is formed with a cam surface 390 which decreases radially and terminates at the shoulder 388. The disc 18 is formed with a second arcuate surface 392. This arcuate surface decreases radially from the vertical plane passing through the center of the connector until it reaches the shoulder 386. The arcuate surface 376 and shoulder 386 define a recess in the outer surface of the disc 18 which is adjacent to and receives therein the driver tooth 108. Preferably, the arcuate surface 392 is complementary to the arcuate surface 376 on the coupling ring. A pin bearing 394 is mounted in a bore 396 at the bottom of the activating disc. The curvature of the notch 380 corresponds to the curvature of the cylindrical pin bearing.

To interconnect the connector members 12 and 14, the polarizing keys 116 and 118 are inserted into the keyways 332 and 328, respectively. The coupling teeth 102 and 104 are inserted into the L-shaped coupling grooves 334 and 336 until they abut the forward facing shoulder 346. At this point, the position of the coupling ring with respect to the disc 18 is shown in FIG. 7(*a*). As shown in FIG. 6(*a*), the contacts are inserted with the contacting surfaces 362 and 364 spaced apart and facing each other. Then the coupling ring is rotated clockwise as viewed in FIG. 7 so that the teeth 102 and 104 move in the coupling grooves. As shown in FIG. 7(*b*), rotation of the coupling ring in such direction also causes the driver tooth 108 to move the insulator upwardly in the direction shown by the arrow. The arcuate surface 376 on the driver tooth constitutes a low force angle cam surface which cooperates with the rotatable pin bearing 394 to effect gradual movement of the contact activating disc with a minimum of torque on the coupling ring. As seen from FIG. 10, the amount of movement of the coupling disc is greater in the present invention than that achieved by the prior art connector, yet with less torque, resistance, and wear, thereby allowing the contacts to be coupled together under greater force.

FIG. 7(*b*) illustrates the position of the coupling ring after it has been rotated 30°. As seen in FIG. 6(*b*), in this position of the coupling ring the contacts 32 in the plug connector move upwardly fully mating with the contacting surfaces on the contacts 62. Further, clockwise rotation of the coupling ring brings the driver tooth 108 to the position illustrated in FIG. 7(*c*) wherein the pin bearing 396 registers with the notch 380 in the cam surface 376. During this last 15° rotation of the coupling ring, the contacts are overloaded, as shown by the curve B between the angles of rotation 30°–45°, in FIG. 10. When the ring 16 reaches the final activated position illustrated in FIG. 7(*c*), wherein the pin bearing 394 registers with the notch 380, the load on the pin bearing is relieved and full contact load between the ring 16 and disc 18 extends over the entire surface 376 of the driver tooth 108. Thus, the load on the contacts will be likewise relieved slightly, and thus the contacts in the final mated position of the connector members will be positioned as illustrated in FIG. 6(*c*) which is identical to the position illustrated in FIG. 6(*b*). The combination of the gradual inclining cam surface 376, the pin bearing 394 and registering notch 380 reduces excessive resistance and wear between the parts of the connector and minimizes the torque required to interconnect the two connector halves. In addition, the registering of the pin bearing with notch 380 produces both an audio signal, i.e. a clicking noise, and a tactile indication when the connector halves are fully mated. A connector constructed in accordance with the present invention utilizing the above described camming arrangement has been subjected to 5000 mating cycles without loss of electrical continuity, connector retention or the tactile indication made when full connector coupling is achieved.

It is noted that the curved surface 392 forming the bottom of the recess in the activating disc 18 is generally complementary in configuration to the curved camming surface 376. Because the camming surface 376 cooperates with the pin bearing 394 to shift the activating disc, it is not necessary that the surface 392 be curved or be complementary to the to the cam surface. For example, the surface 392 could be flat and extend from the pin bearing to the shoulder 386. In addition, the pin bearing 394 and notch 380 could be reversed, in which case, however, the surface 392 on the activating disc must be curved as shown in the drawings since it then functions as a camming surface. It should also be appreciated that the bearing 394 may be a ball bearing rather than a cylindrical pin bearing as shown.

When the coupling ring is shifted to its fully mated position as illustrated in FIG. 7(*c*), the coupling teeth 102 and 104 have moved the full distance of the grooves 334 and 336. Moreover, the driver tooth 106 abuts the shoulder 388. Thus, as it can readily be seen the coupling teeth 102 and 104 together with the grooves 334 and 336 assure that the contacts are separated during the mating of the connector members and that no rotation of the coupling ring occurs until the contacts are directly above each other. To uncouple the connector, it is simply necessary to rotate the coupling ring 16 in the opposite direction indicated by the arrow in FIG. 7, whereby the driver tooth 106 tends to shift the activating disc 18 downwardly until it reaches the position illustrated in FIG. 7(*a*). Then the coupling teeth 102 and 104 can be removed from the L-shaped grooves in the receptacle connector, separating the connector members simultaneously with the uncoupling of the contacts.

Figure 9:
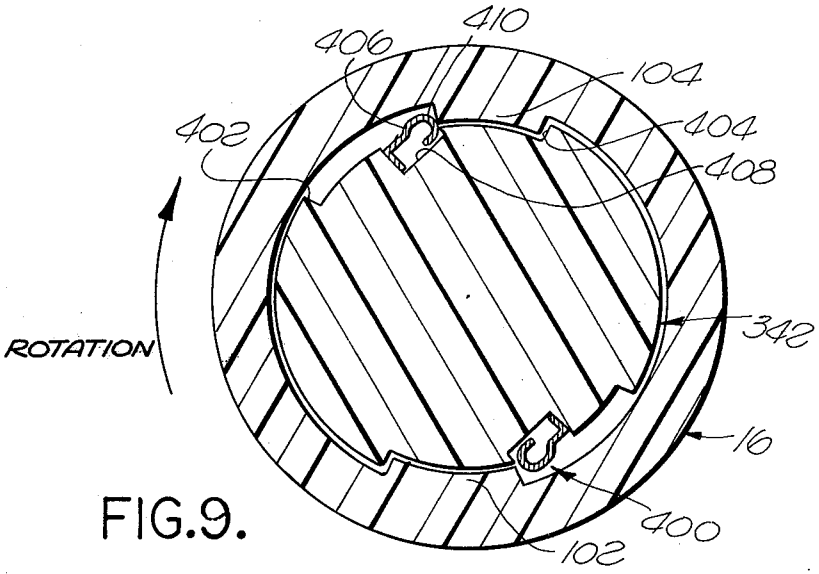
FIG. 9 is a sectional view similar to FIG. 8 showing the coupling ring in its fully mated position.
Figure 8:
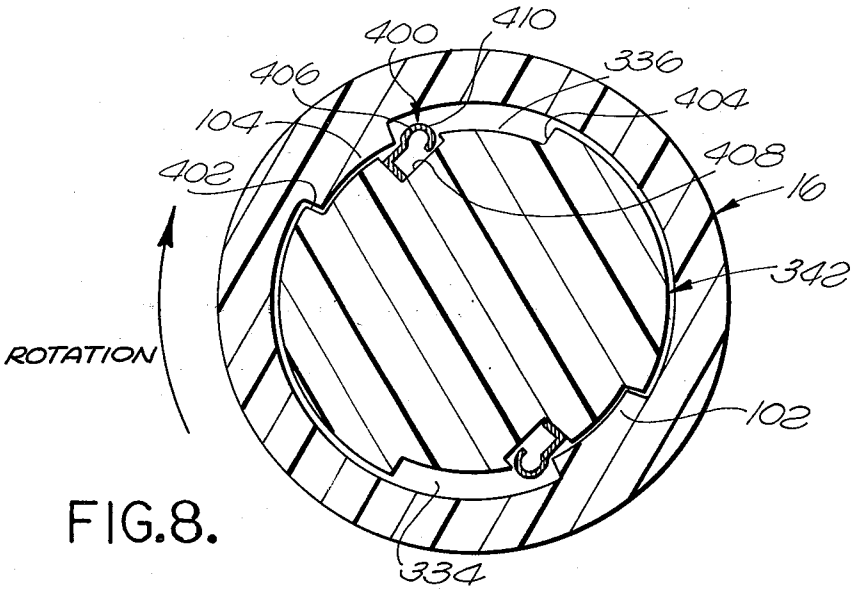
FIG. 8 is a sectional view taken along line 8—8 of FIG. 5 showing the coupling ring of the plug connector member in its initial mated position with the receptacle connector member.

Reference is now made to FIGS. 8 and 9 of the drawings, which illustrate an improved interlocking arrangement which may be used for the two connector members 12 and 14. The improvement in the interlocking arrangement comprises the mounting of a spring detent means, generally designated 400, in the circumferentially exending portions of the L-shaped grooves 334 and 336. Such spring detent means is provided intermediate the opposite ends 402 and 404 of each groove. Each such spring detent means comprises a leaf spring 406 mounted in a recess 408 opening at the outer surface of the groove in the insulator 342, and formed with a curved portion 410 which protrudes beyond the bottom of the groove. As seen in FIG. 8, when the ring 16 is in its inactivated position, the tooth 104, for example, lies in the axially extending portion of the groove 336 and to one side of the spring detent 400. When the coupling ring is rotated in the direction indicated by the arrow in FIG. 8 to shift the activating disc 18 to couple the contacts together and the respective connector members, the tooth 104 slides over the exposed upper curved portion 410 of the spring detent until it reaches the shoulder 404 as seen in FIG. 9 wherein the spring resists reverse movement of the coupling ring. Thus, the leaf spring retracts as the coupling ring shifts between its inactivated and activated positions, lessening the required torque for rotation of the ring and minimizing wear, yet without reducing retention characteristics of the coupling arrangement. The springs also provide a tactile and audio indication of the fully mated condition being achieved at the same time the pin bearing and notch in the activating disc coupling ring provide a similar signal. It will be appreciated that the spring detent 400 need only be provided in one of the grooves 336 or 334, and essentially the same results will be achieved. It will also be noted that the coupling arrangement illustrated in FIGS. 8 and 9 may be embodied in any type of electrical connector utilizing a rotatable coupling ring, and is not limited to use in a low insertion force circular connector as disclosed herein.

What is claimed is:

1. A low insertion force electrical connector comprising:

a first connector member having a first plurality of contacts mounted therein;

a second connector member having a second plurality of contacts mounted therein for electrical engagement with said first plurality of contacts subsequent to mating of said first and second connector members;

said second connector member comprising a stationary insulator and a movable contact activating element, said activating element being formed wit an arcuate surface thereon, said arcuate surface gradually radially decreasing to a generally radially extending shoulder, said insulator and activating element having a plurality of axially aligned bores receiving said second plurality of contacts therein;

a rotatable shell element surrounding said activating element and having an arcuate surface therein generally complementary to said activating element arcuate surface and positioned adjacent thereto prior to engagement of said first and second plurality of contacts, said shell element having a radially extending shoulder thereon abutting said activating element shoulder;

a rotatable bearing in one of said elements projecting beyond its arcuate surface for rolling engagement with the arcuate surface on the other element;

a notch in said other element arcuate surface receiving said bearing when said shell element is rotated a predetermined distance relative to said activating element in the direction causing separation of said shoulders, such rotation of said shell element shifting said activating element in a plane intersecting the axes of said bores whereby said first and second plurality of contacts are engaged with each other.

2. An electrical connector as set forth in claim 1 wherein:

said bearing is mounted in said activating element and said notch is located in said shell element.

3. An electrical connector as set forth in claim 1 wherein:

said bearing is a cylindrical pin bearing and said notch has an arcuate configuration complementary to the cylindrical surface of said pin bearing.

4. An electrical connector as set forth in claim 1 wherein:

said first connector member is formed with an L-shaped groove in its outer surface having one leg of the groove opening at the forward end of said first connector member and the second leg thereof extending circumferentially;

said shell element has a tooth on the inner surface thereof mateable with said groove for interlocking said first and second connector members simultaneously with the engagement of said first and second plurality of contacts; and spring detent means in said second leg of said groove engageable by said tooth during mating of said connector members.

5. A low insertion force electrical connector comprising:

a first connector member having a first plurality of contacts mounted therein;

a second connector member having a second plurality of contacts mounted therein for electrical engagement with said first plurality of contacts subsequent to mating of said first and second connector members;

said second connector member comprising a stationary insulator and a movable contact activating disc, said activating disc being formed with a recess in the outer surface thereof, said recess having a generally radially extending shoulder at one end thereof, a rotatable bearing in said activating disc at its outer surface adjacent to the other end of said recess, said insulator and activating disc having a plurality of axially aligned bores receiving said second plurality of contacts therein;

a rotatable shell surrounding said activating disc and having an arcuate cam surface therein opposing said recess, said cam surface gradually radially decreasing from said bearing to a radially extending shoulder abutting said activating disc shoulder;

said bearing being in rolling engagement with said cam surface; and a notch in said cam surface receiving said bearing when said shell is rotated a predetermined distance relative to said activating disc in the direction causing separation of said shoulders, such rotation of said shell shifting said activating disc in a plane intersecting the axes of said bores whereby said first and second plurality of contacts are engaged with each other.

* * * * *